US007815745B2

(12) United States Patent
Lim

(10) Patent No.: US 7,815,745 B2
(45) Date of Patent: Oct. 19, 2010

(54) HEATER-MOUNTING STRUCTURE OF DISH WASHER, AND THE HEATER

(75) Inventor: Sung Bae Lim, Changwon-si (KR)

(73) Assignee: LG Electronics Inc., Seoul (KR)

( * ) Notice: Subject to any disclaimer, the term of this patent is extended or adjusted under 35 U.S.C. 154(b) by 424 days.

(21) Appl. No.: 10/580,119

(22) PCT Filed: Jun. 7, 2005

(86) PCT No.: PCT/KR2005/001689

§ 371 (c)(1),
(2), (4) Date: May 19, 2006

(87) PCT Pub. No.: WO2006/001609

PCT Pub. Date: Jan. 5, 2006

(65) Prior Publication Data

US 2009/0095333 A1 Apr. 16, 2009

(30) Foreign Application Priority Data

Jun. 24, 2004 (KR) ..... 10-2004-0047435

(51) Int. Cl.
*B08B 3/00* (2006.01)

(52) U.S. Cl. ..... 134/56 D; 134/105; 134/184

(58) Field of Classification Search ..... 134/56 D, 134/105, 184, 198
See application file for complete search history.

(56) References Cited

U.S. PATENT DOCUMENTS

| | | | | |
|---|---|---|---|---|
| 3,963,046 A | | 6/1976 | Bergeson | |
| 5,143,306 A | | 9/1992 | Nilsson | |
| 5,165,433 A | * | 11/1992 | Meyers | 134/104.4 |
| 5,620,014 A | * | 4/1997 | Milocco et al. | 134/108 |
| 5,651,380 A | * | 7/1997 | Sargeant et al. | 134/105 |
| 5,651,382 A | * | 7/1997 | Sargeant et al. | 134/174 |
| 5,709,237 A | * | 1/1998 | Sargeant et al. | 134/174 |
| 5,743,281 A | * | 4/1998 | Sargeant et al. | 134/57 D |
| 5,816,273 A | * | 10/1998 | Milocco et al. | 134/108 |
| 5,829,459 A | * | 11/1998 | Milocco et al. | 134/57 D |
| 5,924,432 A | * | 7/1999 | Thies et al. | 134/56 D |
| 6,432,216 B1 | * | 8/2002 | Thies | 134/18 |
| 6,601,593 B2 | * | 8/2003 | Deiss et al. | 134/25.2 |
| 7,337,790 B2 | * | 3/2008 | Ha | 134/56 D |
| 2003/0213503 A1 | * | 11/2003 | Price et al. | 134/18 |
| 2006/0054201 A1 | * | 3/2006 | Yoon et al. | 134/56 D |

FOREIGN PATENT DOCUMENTS

| | | |
|---|---|---|
| DE | 10239494 | 3/2004 |
| GB | 2080343 | 2/1982 |
| JP | 9-164105 A | 6/1997 |

* cited by examiner

*Primary Examiner*—Joseph L Perrin
(74) *Attorney, Agent, or Firm*—McKenna Long & Aldridge LLP

(57) ABSTRACT

A heater-mounting structure of a dish washer includes a sump housing for storing a washing water inside, and a heater disposed inside the sump housing. A heating portion of a heater is disposed inside the sump housing and bent at least one times.

16 Claims, 3 Drawing Sheets

[Fig. 1]
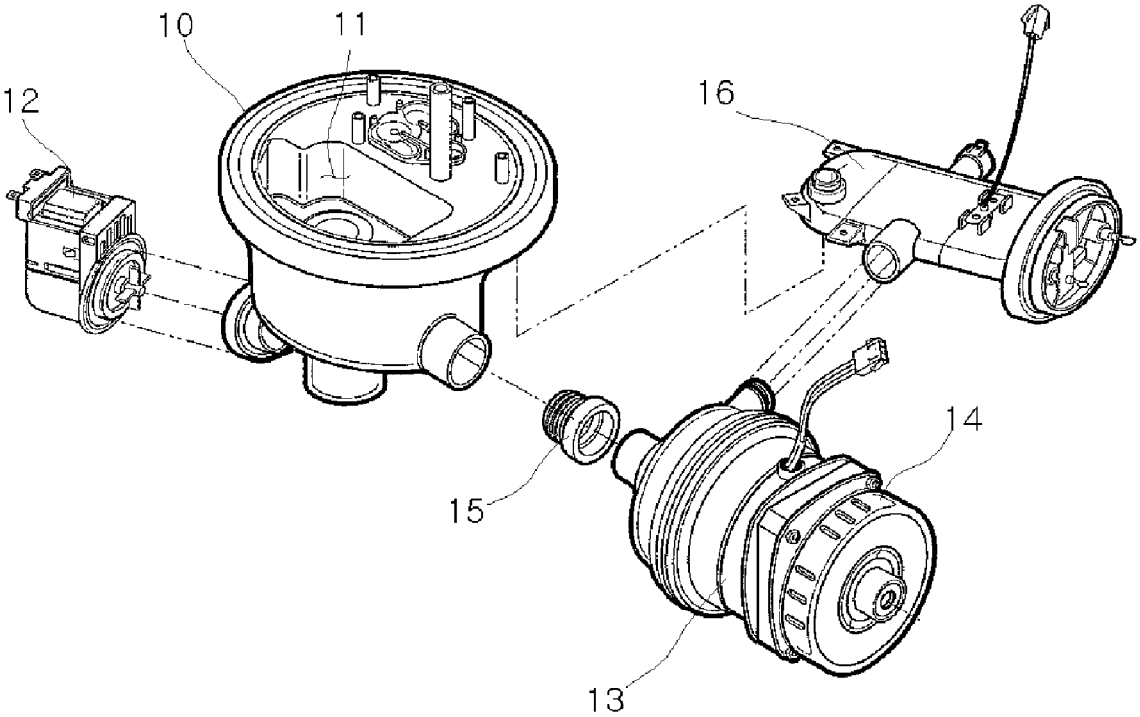

[Fig. 2]
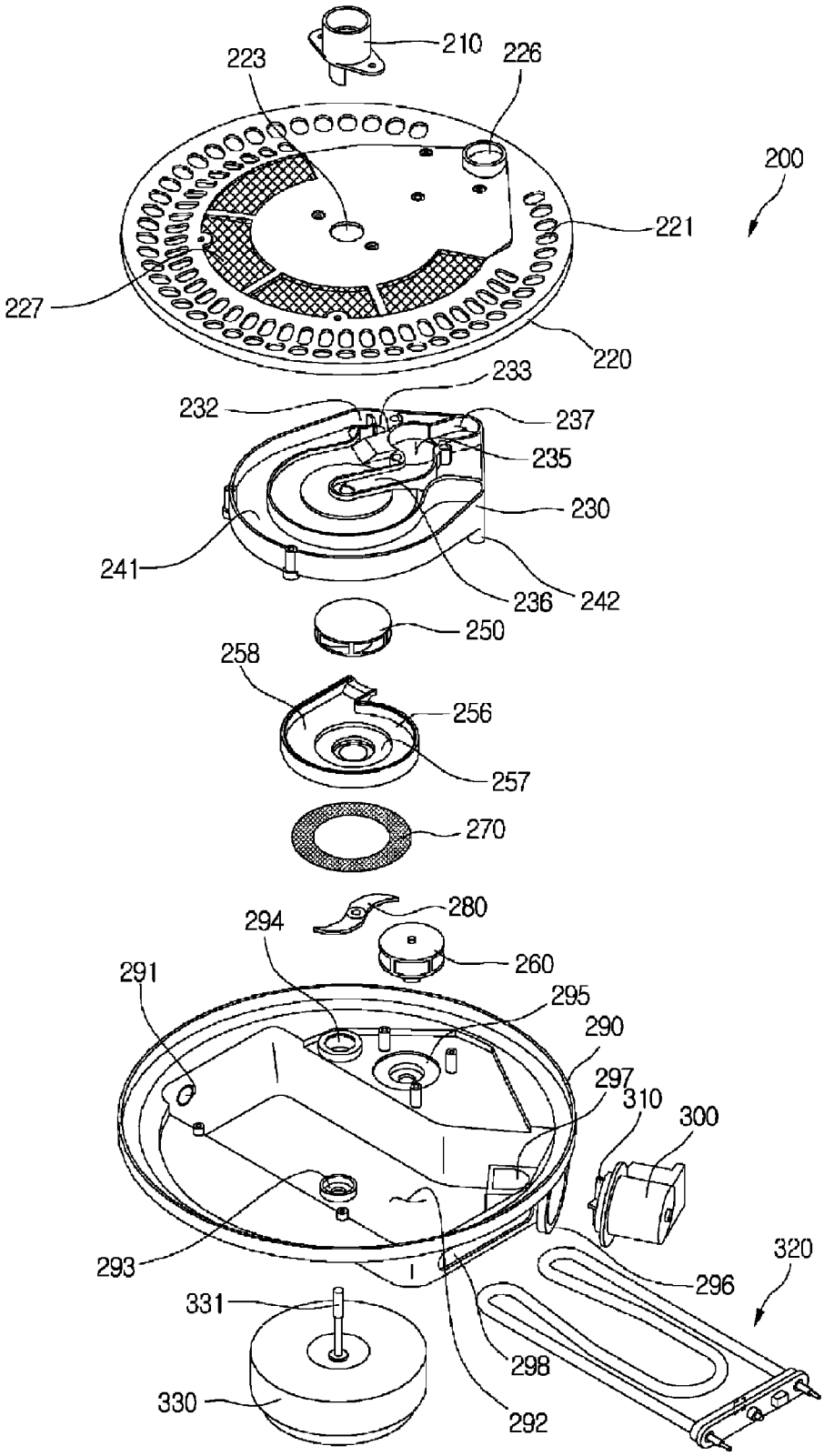

[Fig. 3]
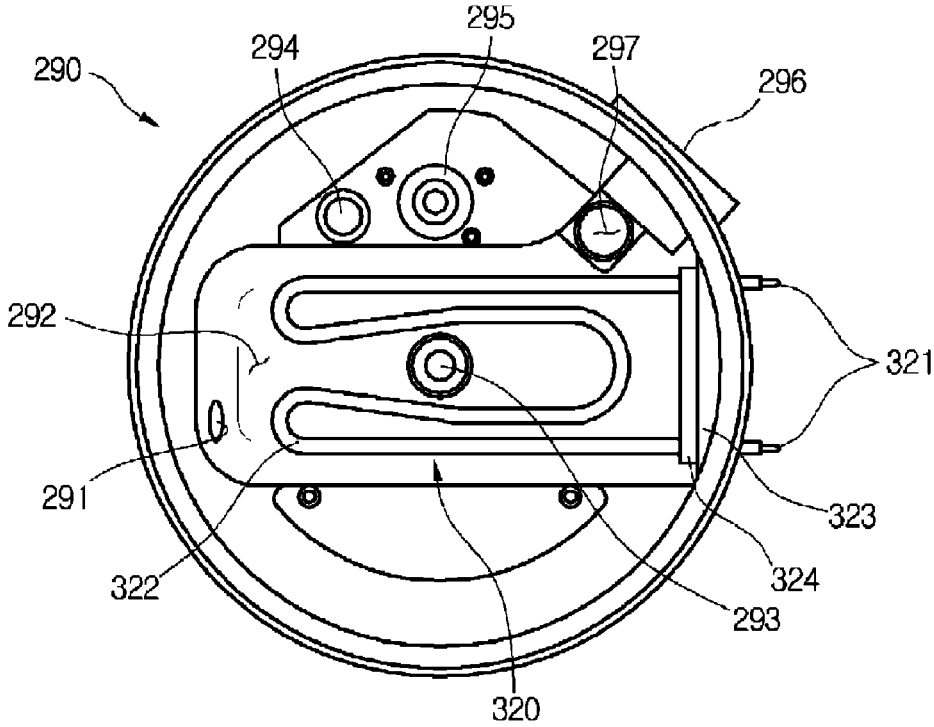
[Fig. 4]
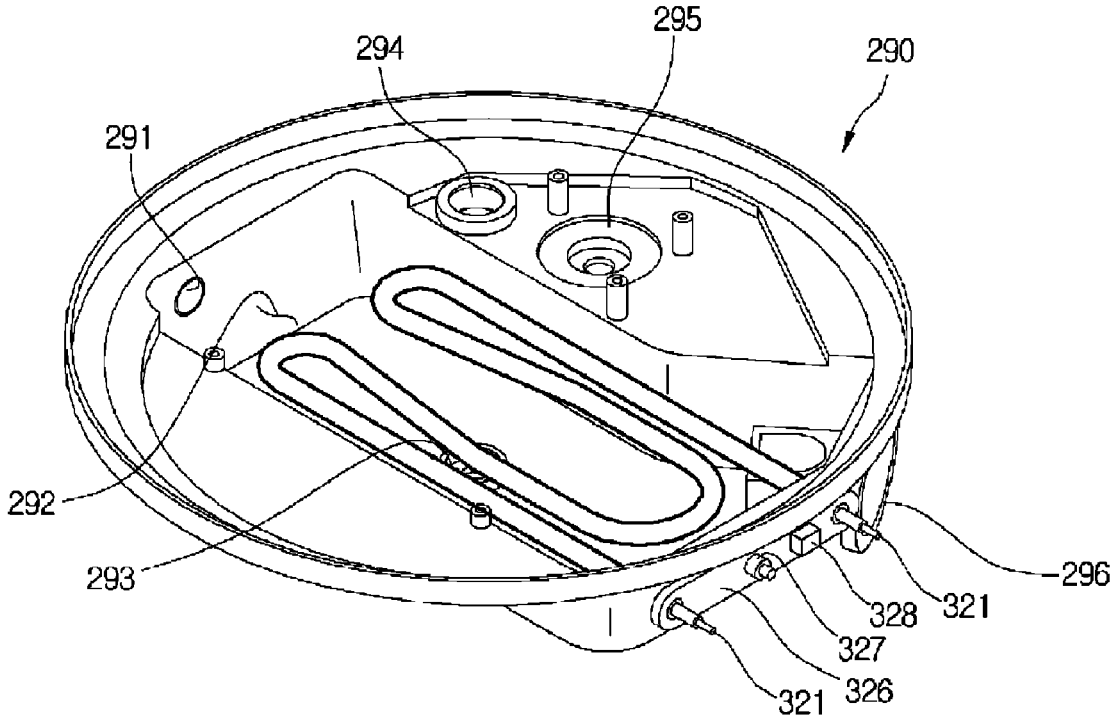

HEATER-MOUNTING STRUCTURE OF DISH WASHER, AND THE HEATER

This application claims priority to International Application No. PCT/KR2005/001689 filed on Jun. 7, 2005, as well as Korean Application 10-2004-47435 filed on Jun. 24, 2004, both of which are incorporated by reference, as if fully set forth herein.

TECHNICAL FIELD

The present invention relates to a dishwasher, and more particularly, to a heater-mounting structure of a dishwasher and a heater mounted thereon.

BACKGROUND ART

Generally, a dishwasher is one of home appliances that can remove food particles from dishes using high-pressure washing water sprayed from nozzles.

A typical dishwasher includes a tub in which dishes are received and washed, a sump mounted under the tub to store a washing water, a washing pump mounted on a side of the sump to pump out the washing water stored in the sump to a spraying nozzle, and a motor for driving the washing pump.

FIG. 1 is an exploded perspective view of a related art sump structure installed in a lower portion of a dishwasher.

Referring to FIG. 1, a related art dishwasher includes a sump 10 mounted under a tub to store a washing water, a washing pump 13 mounted on a side of the sump to pump out the washing water stored in the sump 10 to a spraying nozzle, a motor 14 for driving the washing pump 13.

The dishwasher further includes a heater 16 mounted on a side of the washing pump 13 to heat the washing water, a drain pump 12 mounted on the other side of the sump 10 to drain polluted washing water.

Specifically, a washing water storage 11 for storing the washing water is formed with a predetermined size and depth in the sump 10. A gasket 15 is connected between the sump 10 and the washing pump 13 so as to prevent the washing water from leaking out while the washing water moves from the sump 10 to the washing pump 13.

In the related art dishwasher, the washing water stored in the washing water storage 11 is pumped out by the washing pump 13 and is heated through the heater 16. Then, the washing water moves to each spraying nozzle.

Here, the heater 16 is mounted on the outside of the sump 10. Accordingly, an additional space is required to mount the heater 16 under the tub of the dishwasher. Also, a heater case is required to prevent a fire.

As described above, the related art dishwasher, in which the heater for heating the washing water is mounted on the outside of the sump, has a problem in that an additional space for mounting the heater is required under the tub.

Also, since the heater case is additionally required to surround a heating portion of the heater so as to prevent a fire, the manufacturing cost of the dishwasher increases.

DISCLOSURE OF INVENTION

Technical Problem

Therefore, the present invention has been made in an effort to solve the above-described problems of the typical dishwasher. It is an object of the present invention to provide a heater-mounting structure and a heater mounted thereon, which can minimize an area occupied by the heater under a tub of a dishwasher and reduce an expense for manufacturing a heater.

Technical Solution

To achieve the above object, the present invention provides a heater-mounting structure of a dishwasher, including: a sump housing for storing a washing water; and a heater disposed inside the sump housing.

According to another aspect of the present invention, there is provided a heater mounted in a dishwasher washing dishes received therein, the dishwasher having a washing motor with a motor shaft and a sump housing for storing a washing water, wherein a heating portion of the heater is disposed inside the sump housing and is bent at least one times.

Advantageous Effects

According to a heater-mounting structure of a dishwasher and a heater mounted thereon, an additional space for mounting a heater is not required and thus a size of a sump can be larger. Consequently, a capacity of a washing water stored in the sump can be increased.

In addition, since the heater is mounted inside the sump, it is not required to manufacture a case surrounding a heating portion of the heater. Thus, a manufacture cost can be reduced and a manufacturing process can be simplified.

BRIEF DESCRIPTION OF THE DRAWINGS

FIG. 1 is an exploded perspective view of a related art sump structure installed in a lower portion of a dishwasher.

FIG. 2 is an exploded perspective view of a sump with a heater mounted therein according to the present invention.

FIG. 3 is a plan view of a sump structure with a heater mounted therein according to the present invention.

FIG. 4 is a side perspective view of a sump structure with a heater mounted therein according to the present invention.

BEST MODE FOR CARRYING OUT THE INVENTION

Reference will now be made in detail to the preferred embodiments of the present invention. It is to be understood that the following detailed description of the present invention does not limit the present invention but various modifications and variations can be made in the present invention. Thus, it is intended that the present invention covers the modifications and variations of this invention provided they come within the scope of the present invention.

FIG. 2 is an exploded perspective view of a sump structure with a heater mounted therein according to the present invention.

Referring to FIG. 2, a sump 200 with a heater mounted therein includes a sump housing 290 for storing washing water supplied through a washing water supply tube, a motor 330 mounted under the sump housing 290, and a disposer 280 connected to a motor shaft 331 to grind the garbage.

The sump 200 further includes a pump case 256 which is mounted on the disposer 280 and the washing water stored in the sump housing 290 is pumped out to, and an impeller 250 disposed in the pump case 256 to pump out the washing water. That is, the motor shaft 331 is inserted into a center of the impeller 250 and pumps out the washing water while rotating together with the motor shaft 331.

In addition, the sump 200 further includes a mesh filter 270 mounted between the disposer 280 and the pump case 256 to prevent large garbage among the garbage ground by the disposer 280 from going into the pump case 256.

The sump 200 further includes a soil chamber 230 provided with a pumping passage for guiding the flow of the washing water pumped from the pump case. The soil chamber 230 covers the top of the pump case 256.

The sump 200 further includes a filter 220 disposed on an upper side of the soil chamber 230 and provided at a center and a peripheral portion with a spraying nozzle connector. That is, the spraying nozzle connector is connected to the spraying nozzle to guide the washing water supplied along the pumping passage formed on the soil chamber 230 to each spraying nozzles. A vario valve 260 for selectively guiding the washing water moved along the pumping passage to each spraying nozzle is mounted on a portion of the soil chamber 230.

That is, the filter 220 is provided at a peripheral portion with a washing water hole 221 and a mesh filter 227 for firstly filtering garbage directly removed from the dishes. The filter 220 is further provided at a center portion with an insertion hole 223 in which a lower nozzle arm holder 210 is mounted. The filter 220 is further provided at a peripheral portion with a water guide insertion sleeve 226 in which a lower end of the water guide (not shown) is inserted. The water guide insertion sleeve 226 has a predetermined length and height. That is, the water guide is a washing water flowing tube formed in a O-shape extending from a bottom to an upper side of the tub so that the washing water pumped out by the washing pump 256 flows to an upper spraying nozzle.

The soil chamber 230 is provided at a portion with a vario valve seating portion 235 on which the vario valve 260 is disposed. The soil chamber 230 is further provided at an upper side with a lower nozzle guide passage 236 bending from the vario valve seating portion 235. The soil chamber 230 is further provided with a water guide passage 237 guiding the washing water from the vario valve seating portion 235 to the water guide insertion sleeve 226.

The soil chamber 230 is further provided with a drain passage 241 having a predetermined width and depth formed along an edge of the soil chamber 230. A sensor insertion hole 232 is formed on a first end of the drain passage 241 to receive a sensor. A drain hole 242 being connected to the drain pump and the bottom of the sump is formed on a second end of the drain passage. A sensor is a pollution detecting sensor installed to detect the pollution level while the washing process is being performed.

The soil chamber 230 is further provided with a turbidity sensor guide passage 233 for guiding the washing water pumped out from the pump case 256 to the turbidity sensor inserted in the turbidity sensor insertion hole 232.

Meanwhile, the washing water falling toward the washing water hole 221 is collected in the sump housing 290. The washing water falling toward the mesh filter 227 are filtered by the mesh filter 227 and then are collected in the sump housing 290 along the drain passage 241 formed under the mesh filter 227.

In addition, the pump case 256 is provided with an impeller seating hole 257 for seating the impeller 250 at a center portion. A pumping passage 258 is defined between the outer circumference of the impeller seating hole 257 and the outer circumference of the pump case 256. The pumping passage 258 has a predetermined depth by an outer wall of the pump case 256. Therefore, the washing water directed into the pump case 256 flows to the vario valve 260 along the pumping passage 258.

The sump housing 290 includes a water supply connector 291 formed extending from a side of the bottom, a drain pump case 296 depressed at an opposite side of the water supply connector 291, and a heater receiving portion 292 formed by depressing the inner center.

A motor shaft hole 293 penetrated by a motor shaft is formed on a center of the heater receiving portion 292 and a heater insertion hole 298 is formed on a sidewall of the sump housing 290.

The drain pump case 296 is connected to a soil chamber drain hole 297 and the drain motor 300 is mounted on the drain pump case 296. That is, a drain impeller 310 is mounted in front of the drain motor 300, and drains the washing water through a drain hose rotating in the drain pump case 296.

The sump housing 290 is further provided with a valve seating groove 295 formed on an outer portion of the heater receiving portion 292, and a sensor seating groove 294 formed at a portion distant from the valve seating groove 295.

A flow of the washing water in the sump assembly of the present invention constructed as above will be described briefly. As the motor 330 rotates, the washing water stored in the lower portion of the sump is inhaled toward the impeller 250 mounted in the pump case 256. The washing water pumped out by the rotation of the impeller 250 is firstly purified while passing through the mesh filter 270. The purified washing water is guided to the upper nozzle (not shown) and the lower nozzle (not shown) along the pumping passage 258 defined by the pump case 256 and the soil chamber 230. Here, the washing water is branched off by the vario valve 260 and guided to the upper nozzle and the lower nozzle along the lower nozzle guide passage 236 and the water guide passage 237.

Specifically, the vario valve 260 is designed to allow only one of the upper and lower nozzles 150 and 160 to be opened for a predetermined time. After the pre-determined time passes by, the other one of the upper and lower nozzles 150 and 160 is opened alternately. That is, the vario valve 260 is designed to alternately spray the washing water through the upper and lower nozzles.

A part of the washing water is guided along the passage passes through the turbidity sensor (not shown) and is collected in the lower portion of the sump along the drain passage 241 formed on the edge of the soil chamber 230. In the washing water draining process, the washing water is directed to the drain pump case 296, and when the drain motor 300 operates, the washing water is drained by the rotation of the drain impeller 310.

FIG. 3 is a plan view of a sump structure with a heater mounted therein according to the present invention and FIG. 4 is a side perspective view of the sump structure according to the present invention.

Referring to FIGS. 3 and 4, a heater 320 according to the present invention is received in a heater receiving portion 292 having a predetermined depth and area in the sump housing 290. The heater 320 is inserted from the outside to the inside through a heater insertion hole 298 formed on a sidewall of the sump housing 290.

To be more specific, a heating portion 322 formed in a shape of a rod with a pre-determined width and length is bended several times. An end of the heating portion 322 has a power terminal 321 to which a power is connected, and a sealing member 323 is inserted through the power terminal 321. Before the sealing member 323 is inserted, a pressing plate 324 for pressing the sealing member 323 is inserted. A sealing case 326 is inserted into the rear portion of the sealing member 323 so as to prevent the washing water from leaking out from the heater insertion hole 298. The sealing case 326 is recessed at a predetermined depth so that the sealing member 323 can be seated. The sealing case 326 includes a ground terminal 328 formed between the power terminals 321. Here, the sealing case 326 is closely attached to the outer circumference of the sump housing 290 by a tightening member to be described later.

The pressing plate 324 and the sealing case 326 are firmly tightened by a bolt 325 and a nut 327 penetrating a center portion of the pressing plate 324. That is, as the nut 327 threaded on the outer circumference of the bolt 325 is tightened, the sealing member 323 is compressed strongly between the pressing plate 324 and the sealing case 326. Here, materials having a predetermined elasticity and flexibility are used for the sealing member 323. Preferably, a rubber material can be used.

Specifically, the sealing member 323 is formed with the same size as the heater insertion hole 298 or with a little smaller size. Therefore the sealing member 323 can be easily inserted into the heater inserting hole 298. However, the sealing member 323 is formed more thickly than the sump housing 290. Accordingly, when the sealing member 323 is compressed by the bolt 325 and the nut 327, the upper portion of the sealing member 323 is spreaded at the inner circumference of the sump housing 290 as shown. Consequently, the heater insertion hole 298 is sealed hermetically, and that prevents the washing water from leaking through the heat insertion hole 298.

The heating portion 322 is bent several times, and a center of the heating portion 322 has a little wider interval, so that the interference with the motor shaft 331 can be prevented when the motor shaft 331 penetrates through the motor shaft hole 293.

According to the above-described structure, because the heater 320 is inserted and seated in the center portion of the sump housing 290, the heater case is not needed. In addition, the passage of the washing water from the sump housing 290 to the spraying nozzle is shorter compared with the related art.

INDUSTRIAL APPLICABILITY

According to a heater-mounting structure of a dishwasher of the present invention, a sump capacity is increased, a manufacturing cost is reduced, and a manufacturing process is simplified, so that the industrial applicability of the heater-mounting structure is very high.

The invention claimed is:

1. A dishwasher, comprising;
- a tub for receiving dishes;
- a sump housing which is coupled to a bottom of the tub to store washing water, the sump housing including a heater receiving portion;
- a nozzle assembly including an upper nozzle and a lower nozzle to spray washing water onto the dishes;
- a washing pump placed within the sump housing to pump out the washing water collected in the heater receiving portion, including:
  - a pump case, whole part of which being accommodated within the heater receiving portion; and
  - an impeller disposed in the pump case;
- a washing motor mounted on an outer bottom portion of the sump housing to rotate the impeller; and
- a heater disposed in the heater receiving portion and located adjacent the pump case,
- wherein the sump housing includes
  - a first bottom surface that is lower than the upper end thereof and receives at least one of a valve and sensor thereon; and
  - a second bottom surface that defines the heater receiving portion and is lower than the first bottom surface.

2. The dishwasher according to claim 1, wherein the heater receiving portion is a groove with a predetermined depth and area enough to receive the heater.

3. The dishwasher according to claim 2, wherein the washing motor is mounted on an outer bottom surface of the heater receiving portion.

4. The dishwasher according to claim 1, wherein a heater insertion hole is formed on a sidewall of the sump housing.

5. The dishwasher according to claim 4, wherein the heater includes:
- a heating portion inserted into the heater receiving portion;
- a pressing plate provided at an end portion of the heating portion, and attached to an inner surface of the sidewall to shield the heater insertion hole; and
- a sealing case provided at the end portion of the heating portion, and attached to an outer surface of the sidewall to shield the heater insertion hole.

6. The dishwasher according to claim 5, wherein the pressing plate and the sealing case are tightly attached to the inner and outer surfaces of the sidewall, respectively, by a tightening member including bolt and nut.

7. The dishwasher according to claim 5, wherein the heating portion is bent at least three times in a meandering shape.

8. A dishwasher, comprising;
- a tub for receiving dishes;
- a sump housing which is coupled to a bottom of the tub to store washing water;
- a nozzle assembly including an upper nozzle and a lower nozzle to spray washing water onto the dishes;
- a washing pump to pump out the washing water collected in the sump housing;
- a washing motor mounted on an outer bottom portion of the sump housing, wherein a shaft of the motor passes through the bottom surface of the sump housing and is connected to the washing pump; and
- a heater disposed in the sump housing and located adjacent the washing pump, wherein the sump housing includes
  - a first bottom surface that is lower than the upper end thereof and receives at least one of a valve and sensor thereon; and
  - a second bottom surface that defines the heater receiving portion and is lower than the first bottom surface,
- wherein the water collected within the sump housing is supplied to at least the lower nozzle after being directly heated by contacting the heater.

9. The dishwasher according to claim 8, wherein the shaft vertically extends from the motor.

10. The dishwasher according to claim 9, wherein the sump housing includes a recess to receive the heater.

11. The dishwasher according to claim 10, wherein the water discharged from the nozzle assembly is collected within the recess to be directly heated by the heater.

12. The dishwasher according to claim 10, wherein the washing pump is configured to pump out the water in the recess to at least the lower nozzle.

13. The dishwasher according to claim 8, wherein a heater insertion hole is formed on a sidewall of the sump housing.

14. The dishwasher according to claim 13, wherein the heater includes:
- a heating portion inserted into the heater receiving portion;
- a pressing plate provided at an end portion of the heating portion, and attached to an inner surface of the sidewall to shield the heater insertion hole; and
- a sealing case provided at the end portion of the heating portion, and attached to an outer surface of the sidewall to shield the heater insertion hole.

15. The dishwasher according to claim 14, wherein the pressing plate and the sealing case are tightly attached to the inner and outer surfaces of the sidewall, respectively, by a tightening member including bolt and nut.

16. The dishwasher according to claim 14, wherein the heating portion is bent at least three times in a meandering shape.

* * * * *